US012714271B2

(12) United States Patent
Newkirk

(10) Patent No.: US 12,714,271 B2
(45) Date of Patent: Aug. 25, 2026

(54) CONVERTIBLE SURFACE CLEANING APPARATUS

(71) Applicant: BISSELL Inc., Grand Rapids, MI (US)

(72) Inventor: Tyler Newkirk, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 405 days.

(21) Appl. No.: 18/500,177

(22) Filed: Nov. 2, 2023

(65) Prior Publication Data

US 2024/0180374 A1 Jun. 6, 2024

Related U.S. Application Data

(60) Provisional application No. 63/429,196, filed on Dec. 1, 2022.

(51) Int. Cl.

| | |
|---|---|
| ***A47L 5/22*** | (2006.01) |
| ***A47L 5/24*** | (2006.01) |
| ***A47L 5/30*** | (2006.01) |
| ***A47L 9/04*** | (2006.01) |
| ***A47L 9/32*** | (2006.01) |

(52) U.S. Cl.

CPC ..... *A47L 5/225* (2013.01); *A47L 5/24* (2013.01); *A47L 5/30* (2013.01); *A47L 9/0411* (2013.01); *A47L 9/322* (2013.01); *A47L 9/325* (2013.01)

(58) Field of Classification Search

CPC ... A47L 5/24; A47L 5/225; A47L 5/30; A47L 5/8225; A47L 9/0018–0045; A47L 9/0411; A47L 9/322; A47L 9/325

See application file for complete search history.

(56) References Cited

U.S. PATENT DOCUMENTS

| | | | | |
|---|---|---|---|---|
| RE32,751 | E | 9/1988 | Joss et al. | |
| 9,924,842 | B2 | 3/2018 | Gu et al. | |
| 9,955,831 | B2 * | 5/2018 | Bilger | A47L 9/325 |
| 10,080,471 | B2 * | 9/2018 | Reimer | A47L 5/30 |
| 10,165,914 | B2 * | 1/2019 | Conrad | A47L 5/24 |
| 10,561,290 | B2 | 2/2020 | Pi et al. | |
| 10,918,248 | B2 * | 2/2021 | Ford | A47L 9/244 |
| 2014/0352105 | A1 * | 12/2014 | Bosses | A47L 9/009 15/415.1 |
| 2018/0000298 | A1 * | 1/2018 | Kettle Aiers | A47L 9/325 |

FOREIGN PATENT DOCUMENTS

| | | | | |
|---|---|---|---|---|
| CN | 105816104 | A | 8/2016 | |
| CN | 107224247 | A | 10/2017 | |
| CN | 208510940 | U | 2/2019 | |
| CN | 213155651 | U | 5/2021 | |
| GB | 2503022 | A | 12/2013 | |
| JP | 2016137165 | A | 8/2016 | |
| JP | 6435204 | B2 * | 12/2018 | A47L 9/322 |
| KR | 100582080 | B1 | 5/2006 | |

OTHER PUBLICATIONS

Machine translation of JP-6435204-B2; Retrieved from ESPACENET on Jan. 14, 2026 (Year: 2026).*

* cited by examiner

*Primary Examiner* — Sang K Kim

(74) *Attorney, Agent, or Firm* — Warner Norcross + Judd LLP

(57) ABSTRACT

A surface cleaning apparatus having a convertible wand is configurable in an upright mode or a handheld mode. In the upright mode, the wand forms an elongated handle for maneuvering the surface cleaning apparatus over a floor surface. In the handheld mode, the wand forms a compact handle for carrying and maneuvering a handheld unit.

17 Claims, 5 Drawing Sheets

CONVERTIBLE SURFACE CLEANING APPARATUS

CROSS-REFERENCE TO RELATED APPLICATION(S)

This application claims the benefit of U.S. Provisional Patent Application No. 63/429,196, filed Dec. 1, 2022, which is incorporated herein by reference in its entirety.

BACKGROUND

Convertible surface cleaning apparatus or floor cleaners are convertible between an upright configuration for cleaning a floor and a portable or handheld configuration for cleaning stairs, surfaces above the floor, and other hard to reach areas. Conventional convertible floor cleaners have a housing including a cleaning head or base and an upright body having a handle, with a portable or handheld cleaning unit mounted on the housing. In the upright configuration, the handheld unit is attached to the housing, and the user grips the handle to maneuver the base over a floor surface to be cleaned. In the handheld configuration, the handheld unit is removed from the housing.

Conversion between upright and handheld configurations has proved challenging to current convertible floor cleaner designs. In order to use the handheld vacuum cleaner on stairs or for above-floor cleaning, current architectures require the user to remove the handle and base completely, and to find a place to hang or lean the handle and base before they can begin cleaning. Other convertible floor cleaners are heavy and/or cumbersome to convert between the different configurations. A need remains for a convertible floor cleaner that is easy to use, convenient, and lightweight.

BRIEF SUMMARY

A convertible surface cleaning apparatus with a retractable wand is provided herein. In an exemplary embodiment, the surface cleaning apparatus is convertible between an upright mode and a handheld mode. The wand may be fully retracted into a portable or handheld cleaning unit in the handheld mode.

In one aspect of the disclosure, a surface cleaning apparatus includes a surface cleaning head, a handheld unit comprising a power source and a wand pocket, and a wand coupled with the handheld unit, the wand comprising a hand grip at one end thereof and configured to be retracted into the wand pocket, wherein the surface cleaning apparatus is convertible to an upright mode, where the wand is extendible from the handheld unit and the handheld unit is coupleable to the surface cleaning head to convert the surface cleaning apparatus to the upright mode, or convertible to a handheld mode, where the wand is retractable into the wand pocket on the handheld unit and the handheld unit is detachable from the surface cleaning head to convert the surface cleaning apparatus to the handheld mode.

In another aspect of the disclosure, a surface cleaning apparatus includes a surface cleaning head having a first inlet, a handheld vacuum unit comprising a suction source comprising a vacuum motor, a collection container in fluid communication with the suction source, a second inlet in fluid communication with the collection container, a power source, and a wand pocket, and a wand coupled with the handheld vacuum unit, the wand comprising a hand grip at one end thereof and configured to be retracted into the wand pocket, wherein the surface cleaning apparatus is convertible to an upright mode, where the wand is extendible from the handheld vacuum unit and the vacuum unit is coupleable to the surface cleaning head with the second inlet of the handheld vacuum unit in fluid communication with the first inlet to convert the surface cleaning apparatus to the upright mode, or convertible to a handheld mode, where the wand is retractable into the wand pocket on the handheld vacuum unit and the handheld vacuum unit is detachable from the surface cleaning head to convert the surface cleaning apparatus to the handheld mode.

These and other features and advantages of the present disclosure will become apparent from the following description of particular embodiments, when viewed in accordance with the accompanying drawings and appended claims.

DETAILED DESCRIPTION

Figure 1:
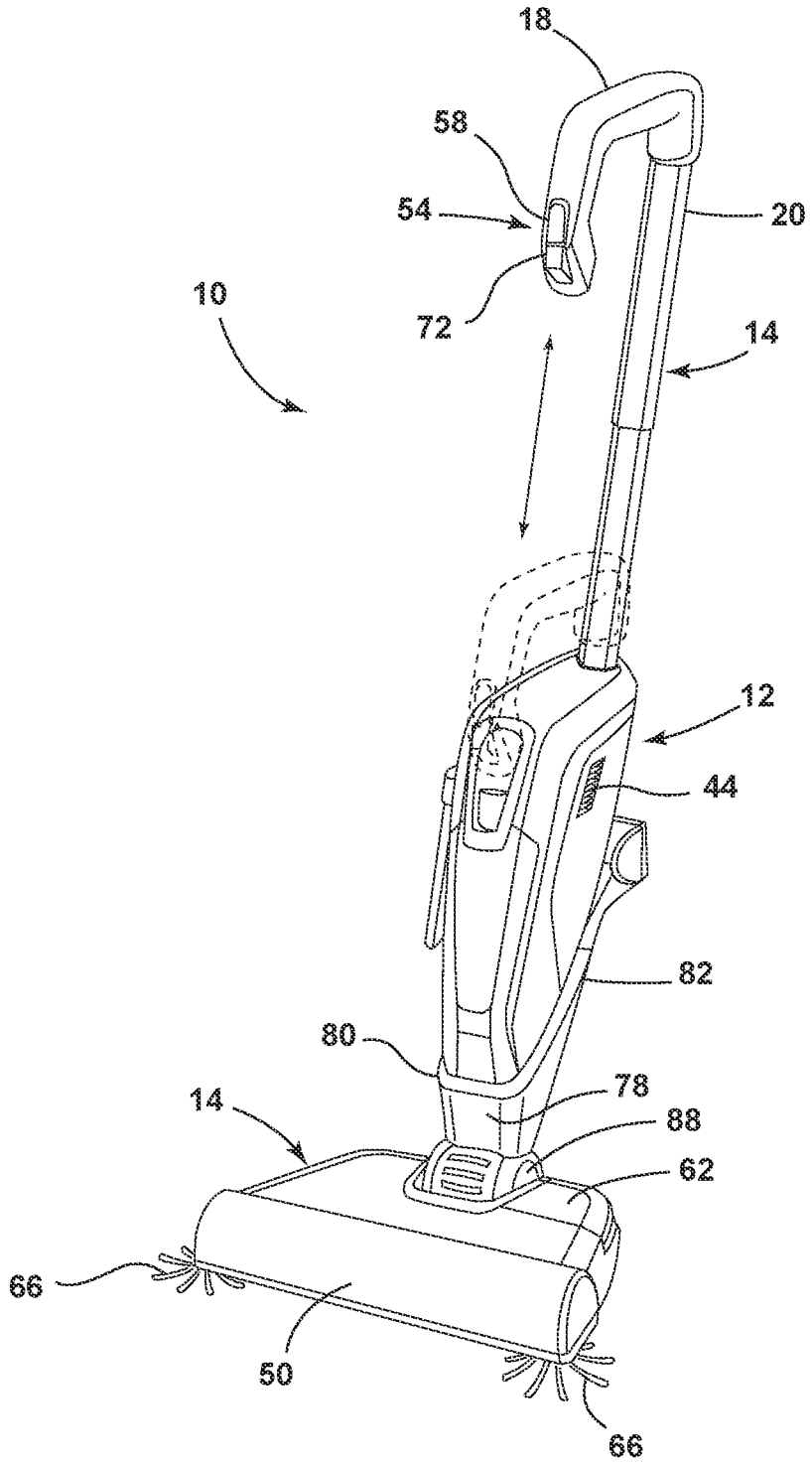
FIG. 1 is a perspective view of a surface cleaning apparatus in the form of a convertible vacuum cleaner according to one aspect of the disclosure, with the surface cleaning apparatus in an upright mode, with a handheld unit attached to a surface cleaning head and a wand extended from the handheld unit.
Figure 2:
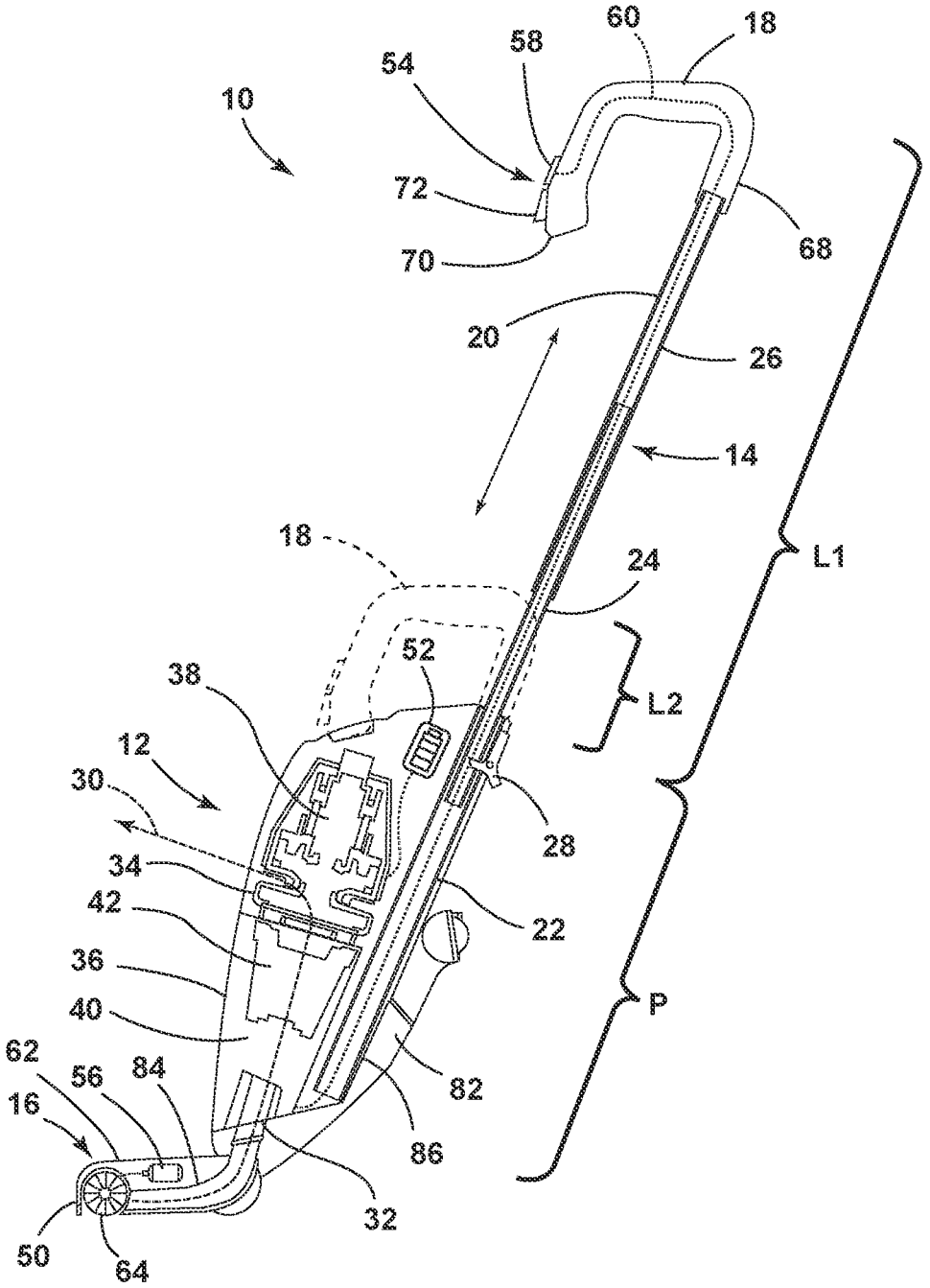
FIG. 2 is a cross-sectional view of the surface cleaning apparatus, with the wand in an extended position.

In an exemplary embodiment shown in FIGS. 1-2, wherein like numerals indicate corresponding parts throughout the several views, a surface cleaning apparatus is illustrated and generally designated at 10. As discussed in further detail below, the surface cleaning apparatus 10 is provided with various features and improvements, including a fully retractable and/or convertible wand 14. The wand 14 can form an elongated handle for maneuvering the surface cleaning apparatus over a floor surface in an upright mode. In a handheld mode, the wand 14 can form a compact handle for carrying and maneuvering a handheld unit of the apparatus.

The apparatus 10 of the illustrated embodiment, which may alternatively be referred to herein as a vacuum cleaner or stick vacuum, includes a handheld unit 12, a wand 14, and a surface cleaning head 16. The apparatus 10 is convertible between different modes of operation to efficiently clean different surface types and hard-to-reach areas.

For purposes of description related to the figures, the terms "upper," "lower," "right," "left," "rear," "front," "vertical," "horizontal," "inner," "outer," and derivatives thereof shall relate to the apparatus as oriented in FIG. 1 from the perspective of a user behind the apparatus 10 in a typical operating position. However, it is to be understood that the apparatus may assume various alternative orientations, except where expressly specified to the contrary.

Figure 4:
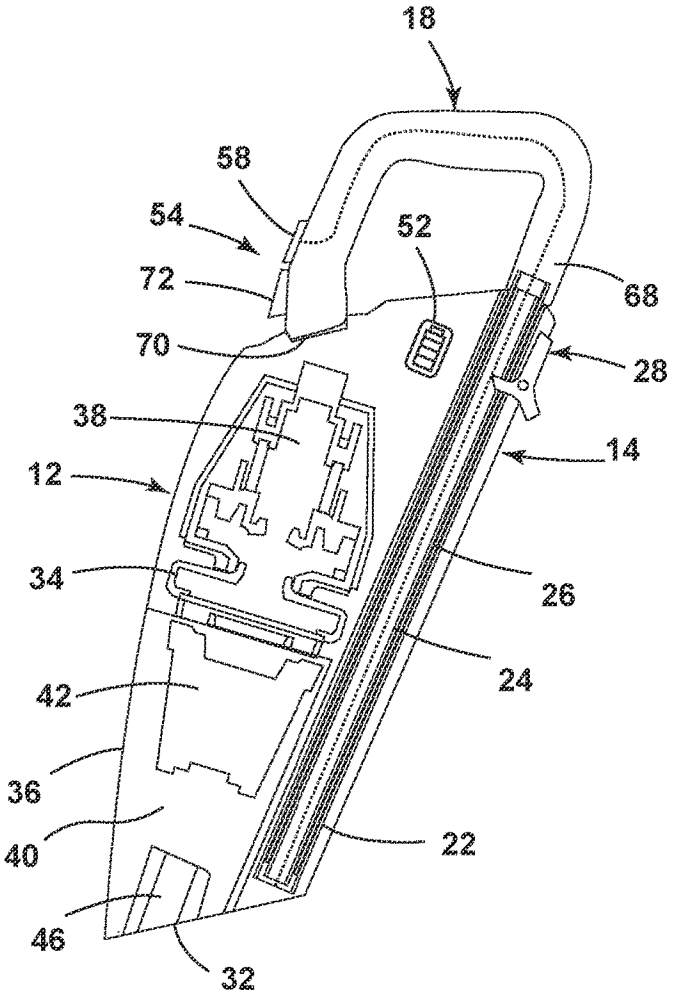
FIG. 4 is a cross-sectional view of the handheld unit in the handheld mode of FIG. 3.
Figure 3:
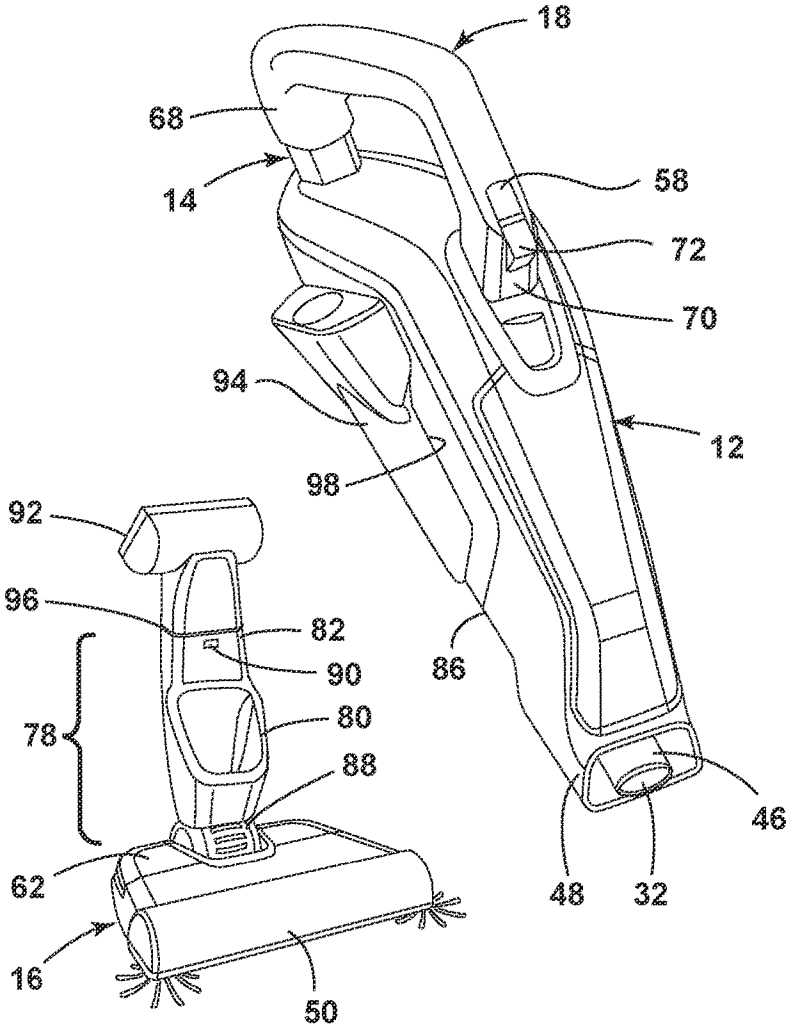
FIG. 3 is a perspective view of the surface cleaning apparatus in a handheld mode, with the handheld unit separated from a surface cleaning head and the wand is retracted into the handheld unit.
Figure 5:
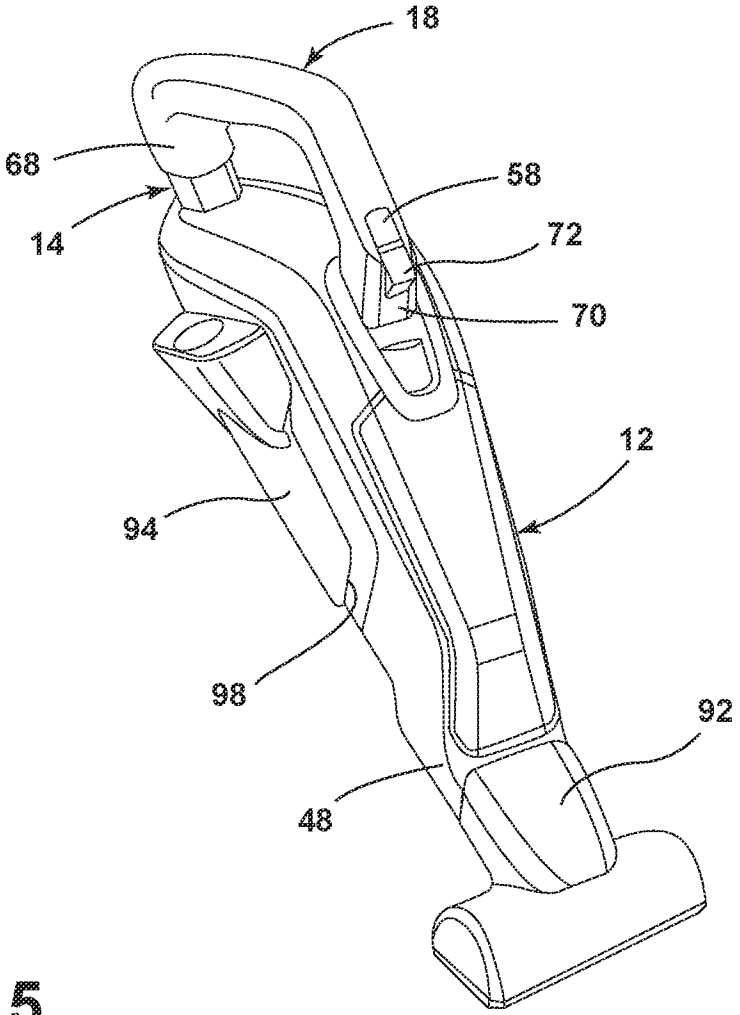
FIG. 5 is a is a perspective view of the handheld unit in a handheld mode, with an accessory tool attached to the handheld unit.

The apparatus 10 is convertible between an upright mode, an example of which is shown in FIG. 1-2, in which the wand 14 is extended from the handheld unit 12 and the surface cleaning head 16 is attached to the handheld unit 12, and the handheld mode, an example of which is shown in FIGS. 3-5. The upright mode may be useful for cleaning floor surfaces, while the handheld mode may be useful for cleaning other surfaces such as stairs, upholstery, furniture, countertops, and hard-to-reach areas. The apparatus 10 may also be convertible to a compact storage mode, where the wand 14 is retracted while the handheld unit 12 remains attached to the cleaning head 16.

The handheld unit 12 can comprise a modular, hand-carriable unit that can be used independently of the surface cleaning head 16 to clean a surface. To that end, the surface cleaning head 16 is removable or detachable from the handheld unit 12, as shown in FIGS. 3-5 for operation in the handheld mode. Conveniently, the wand 14 is retractable into the handheld unit 12 for the handheld mode, and a hand grip 18 of the wand 14 can form a handle for carrying the unit 12.

With the wand 14 retracted, the hand grip 18 and the handheld unit 12 can cooperatively form a handle for carrying and maneuvering the handheld unit 12 in the handheld mode. The hand grip 18 is preferably spaced from and unconnected to the handheld unit 12 in the upright mode, and connected to the handheld unit 12 in the handheld mode.

The wand 14 is configured to remain attached to the handheld unit 12 when the handheld unit 12 is decoupled from the surface cleaning head 16 during use in the handheld mode. In one embodiment, the wand 14 and/or the handheld unit 12 comprises a stop feature that prevents complete disengagement of the wand 14 from the handheld unit 12. The stop feature can limit extension of the wand 14 to an extended length L1, which may be a maximum extended length in embodiments where the wand 14 has a variable length.

Referring to FIG. 1, the wand 14 includes an elongated handle 20, which may, for example, be formed as a hollow tube member, a telescoping tubular assembly, or as a solid member, with the hand grip 18 at one end of the handle 20. The handle 20 is extendible from the handheld unit 12 and the handheld unit 12 is coupleable to the surface cleaning head 16 to convert the surface cleaning apparatus 10 to the upright mode, one example of which is shown in solid line in FIG. 1.

Referring to FIG. 2, the handheld unit 12 has a wand pocket 22, and the wand 14 is coupled with the handheld unit 12 and is configured to be retracted into, or extended from, the wand pocket 22. In one embodiment, the handle 20 is retractable into the wand pocket 22 on the handheld unit 12 and the handheld unit 12 is detachable from the surface cleaning head 16 to convert the surface cleaning apparatus 10 to the handheld mode. In the retracted position, the wand 14 can have a retracted length L2, which may be a minimum length of the wand.

The apparatus 10 can include a wand latch 28 adapted to releasably latch the wand 14 in the extended position and prevent retraction of the handle 20 into the pocket 22. The wand latch 28 can be configured to latch the handle 20 in an extended position as shown in FIG. 1-2, e.g. a position in which the handle 20 is at least partially extended from the pocket 22.

In some embodiments, the wand latch 28 can also latch the wand 14 in the retracted position and prevent extension of the handle 20 out of the pocket 22. In other embodiments, a separate latch or other securement feature for the retracted position is provided.

Figure 6:
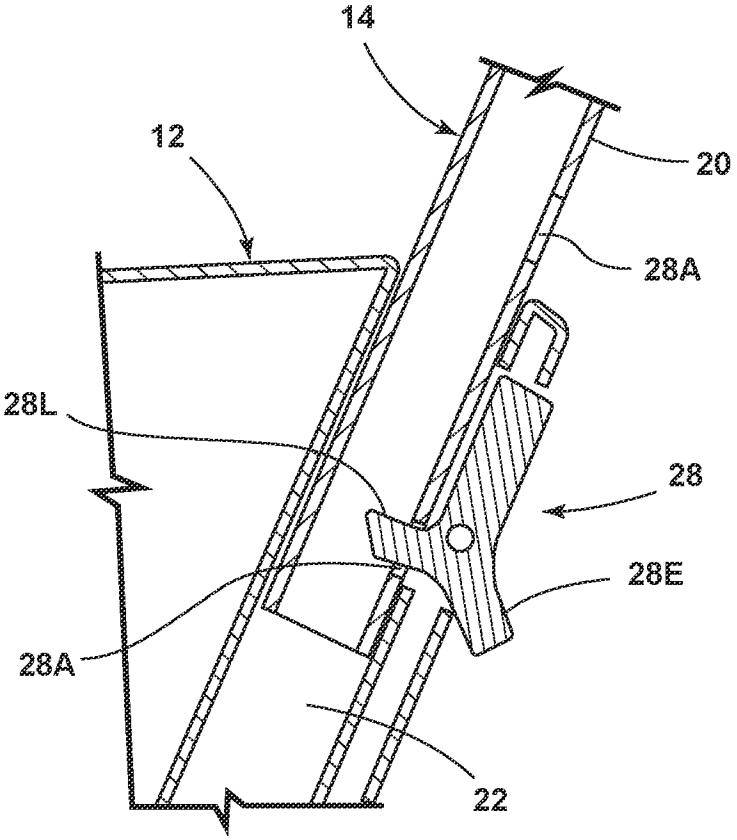
FIG. 6 is a schematic sectional view of a wand latch according to one aspect of the disclosure, the wand latch adapted to releasably latch the wand in the extended position.

The wand latch 28 can comprise any suitable latch, such as a spring-loaded ball, pin, or lever carried by one of the handheld unit 12 and the wand 14 that engages a hole, groove, or recess, or one of a plurality thereof, in the other. Referring to FIG. 6, in one non-limiting example, the wand latch 28 can comprises a spring-biased lever 28L carried by the handheld unit 12 and which engages an aperture 28A in the handle 20. A user may retract the wand 14 by pressing an exposed end 28E of the lever 28L to withdraw the lever 29L from the aperture 28A, thereby freeing the handle 20 for retraction into the pocket 22.

To adjust the extended length of the wand 14, for example to accommodate users of different heights, the wand 14 can have multiple apertures 28A in the handle 20, and the lever 28L can engage any one of the apertures 28A.

In one embodiment, the handle 20 is a telescoping tubular assembly including an inner tube 24 and an outer tube 26 that slides or telescopes along an outer surface of the inner tube 24. The inner and outer tubes 24, 26 are both extended from the pocket 22 in the upright mode. A portion the inner tube 24 may remain in the pocket 22 when extended. A telescoping arrangement allows the extended length L of the wand 14 to be greater than a length P of the wand pocket 22, and can allow the hand grip 18 to be set to a comfortable height by the user.

The inner and outer tubes 24, 26 can be releasably latched together to prevent telescopic movement between the inner and outer tubes 24, 26. To adjust the length of the wand 14, for example to accommodate users of different heights, the wand 14 can have multiple extended positions in which the tubes 24, 26 can be latched together. Structures for latching telescoping tubes together are known in the art and include, but are not limited, spring-loaded balls, pins, or levers carried by one of the tubes 24, 26 that engages a hole, groove, or recess, or one of a plurality thereof, in the other tube 24, 26, a flip lock carried on the outer tube 26, or a twist lock operated by twisting the tubes 24, 26 in opposing directions.

In another embodiment, the handle 20 for the wand 14 comprises a single tube and/or a non-telescoping assembly. In such an arrangement, the extended length L1 of the wand 14 may be equal to or less than the length P of the wand pocket 22. In another arrangement, the extended length L1 of the wand 14 may be greater than the length P of the wand pocket 22, such that the wand 14 may partially protrude from the wand pocket 22 in the retracted position.

The handheld unit 12 can include one or more cleaning systems. In one embodiment, the handheld unit 12 is a vacuum unit having a vacuum collection system for creating a partial vacuum to suck up debris (which may include dirt, dust, soil, hair, and other debris) from a surface to be cleaned and collecting the removed debris in a space provided on the handheld unit 12 for later disposal. Other cleaning systems include, but are not limited to a cleaning fluid delivery system, i.e. a liquid delivery system and/or a steam delivery system.

The vacuum collection system can include a working air path 30, a suction inlet 32, a suction source 34 in fluid communication with the suction inlet 32 for generating a working air stream, and a debris removal assembly 36 for removing and collecting debris (which can be solid, liquid, or a combination thereof) from the working airstream for later disposal. The suction source 34 can comprise a vacuum motor 38. In addition to the aforementioned components, the vacuum collection system may include one or more filters, upstream or downstream of the suction source 34, to separate debris from the working airstream.

The debris removal assembly 36 can include a collection container 40 for separating and collecting debris from the working airstream for later disposal. A separator 42 can be formed in a portion of the collection container 40 for separating entrained debris from the working air stream, and comprises a filter assembly provided downstream of the suction inlet 32 and upstream of the suction source 34. Alternatively, the debris removal assembly 36 can include a cyclonic or centrifugal separator, a flexible and air-permeable filter bag, or other air filtering means.

To provide a slim upright body in the upright configuration, the collection container 40 and vacuum motor 38 can be oriented in a stacked orientation, with the vacuum motor 38 being vertically above the collection container 40. This not only provides a compact unit in the handheld configuration, but also provides for a compact storage scenario in the upright configuration. The wand pocket 22 may be disposed rearwardly of the vacuum motor 38 and the collection container 40.

A portion of the hand grip 18 extends over at least one of the vacuum motor 38 and the collection container 40 in the handheld mode or when the wand 14 is retracted. By providing the hand grip 18 over one or both of these components 38, 40, the weight-in-hand of the handheld unit 12 is reduced.

In the handheld mode, the working air path may be primarily defined through the handheld unit 12, with the suction inlet 32 defining a dirty air inlet for the working air path 30. In the handheld mode, the working air path 30 can extend from the suction inlet 32 to a clean air outlet 44 (FIG. 1) on the handheld unit 12. In the handheld mode, the suction inlet 32 may be used to directly clean a surface. Alternatively, as discussed in further detail below, a tool can be attached to the suction inlet 32 and the tool may have a suction inlet defining a dirty air inlet for the working air path 30 in the handheld mode.

Referring to FIG. 3, the suction inlet 32 of the illustrated example includes an inlet duct 46. The inlet duct 46 can extend away from a forward end or nose 48 of the handheld unit 12. The forward end/nose 48 may, in some embodiments, be a forward end or nose of the collection container 40, with the inlet duct 46 being formed with the collection container 40. Other configurations for the suction inlet 32 are possible.

In the upright mode, the working air path 30 may be defined through the cleaning head 16 and the handheld unit 12, as described in further detail below. The cleaning head 16 can include a suction inlet, or suction nozzle 50, that is in fluid communication with the suction source 34 and defines the dirty air inlet for the working air path 30 in the upright mode.

The cleaning head 16 can comprise a base 62 adapted to move over a surface to be cleaned, e.g. a surface-engaging and/or floor-traversing base. The base 62 can house one or more floor cleaning implements or agitators, such as a brushroll 64 and/or an edge cleaning brush 66. Other examples of floor cleaning implements include, but are not limited to dual horizontally-rotating brushrolls, one or more vertically-rotating brushrolls, a stationary brush, and/or a cleaning pad.

The base 62 can house a brush motor 56, which is operably coupled with the brushroll 64 via a transmission arrangement, which can include one or more belts, gears, shafts, pulleys, or combinations thereof. In some embodiments, the brush motor 56 can additionally drive rotation of the edge cleaning brushes 66. In yet another embodiment, a separate edge cleaning brush motor is provided within the base 62

The suction nozzle 50 can be provided on the base 62, and the brushroll 64 can be provided within or adjacent to the suction nozzle 50 to agitate the surface to be cleaned so that the debris is more easily ingested into the suction nozzle 50. The suction nozzle 50 can be removable from the base 62, partially removable from the base 62, or non-removable from the base 62.

The handheld unit 12 has a power source 52 electrically connected to at least one electrical component in the handheld unit 12. For example, the power source 52 can supply power to the suction source 34 or vacuum motor 38, and a user interface 54. In one embodiment, the power source 52 comprises a battery that is rechargeable and/or replaceable, for a "cordless" apparatus 10. A cord (not shown) may be used to connect the battery to an external power source for charging the battery and/or for connecting the battery to powered components in the apparatus 10. In another embodiment, the power source 52 is a power cord adapted to be connected to an external power source (e.g., AC power or a household power outlet) to operate the apparatus 10.

The power source 52 can supply power to at least one electrical component in the surface cleaning head 16 in the upright mode. For example, the power source 52 can supply power to a brushroll motor 56 (FIG. 2) and/or a pump (not shown) that delivers cleaning fluid to the surface to be cleaned.

The user can interact with the apparatus 10 through the user interface 54. The user interface 54 can enable operation and control of the apparatus 10 from the user's end, and can also provide feedback information from the apparatus 10 to the user. The user interface 54 can be electrically coupled with electrical components, including, but not limited to, circuitry electrically connected to various components of the vacuum collection system of the apparatus 10.

In one embodiment, the user interface 54 is located on the hand grip 18. The user interface 54 includes at least one input control 58, such as, but not limited to, a button, trigger, toggle, key, switch, or the like, to affect and control operation of the apparatus 10. In one embodiment, the input control 58 is a power button that controls the supply of power to one or more electrical components of the apparatus 10. Other examples of input controls include a mode button that cycles the apparatus 10 between different cleaning modes. The user interface 54 can include at least one indicator, such as, but not limited to, a battery level indicator or a suction level indicator.

An electrical conductor 60 within the wand 14 can electrically couple the user interface 54 with the power source 52. The electrical conductor 60 can, for example, extend within a hollow interior of the wand 14, and may be a wire or cable. In another embodiment, the electrical conductor 60 can extend at least partially on an exterior of the wand 14. The electrical conductor 60 can supply power and/or data signals between the user interface 54 and the handheld unit 12.

In some embodiments, the handheld unit 12 can comprise a winding mechanism (not shown) to automatically retract and wind the electrical conductor 60. For example, as the wand 14 retracts into the handheld unit 12, the electrical conductor 60 can retract and wind onto a reel. As the wand 14 extends, the electrical conductor 60 can extend and spool off the reel.

Referring to FIGS. 3-4, the hand grip 18 can have a first end 68 connected with the wand 14 and a second end 70. The second end 70 can engage with the handheld unit 12 in the handheld mode. In one embodiment, the hand grip 18 and handheld unit 12 form a closed loop handle in the handheld mode. In another embodiment, the hand grip 18 alone can form the handle for carrying and maneuvering the handheld unit 12 in the handheld mode.

The hand grip 18 can extends forwardly from the wand 14. In the illustrated embodiment, the hand grip 18 extends forwardly from an upper end of the wand 14 and downwardly in front of the upper end of the wand 14, which can place the second end 70 in front of the first end 68. With such a configuration, the hand grip 18 extends over at least one of a rear portion and a top portion of the handheld unit 12 in the handheld mode.

The apparatus 10 can have a grip latch 72 to latch the hand grip 18 to the handheld unit 12 in the handheld mode. The grip latch 72 is adapted to releasably latch the hand grip 18 to the handheld unit 12 and prevent extension of the wand 14 from the wand pocket 22. Release of the grip latch 72 permits extension of the wand 14 from the wand pocket 22.

The grip latch 72 can comprise any suitable latch that can be carried by the hand grip 18 or the handheld unit 12, and that can interact with a corresponding latching feature on the other one of the hand grip 18 or the handheld unit 12. Conveniently, in some embodiments the second end 70 of the hand grip 18 can have the grip latch 72 for connection to the handheld unit 12, such that a user is able to hold the grip 18 in one hand and operate the grip latch 72 using a thumb or finger of the same hand.

Figure 7:
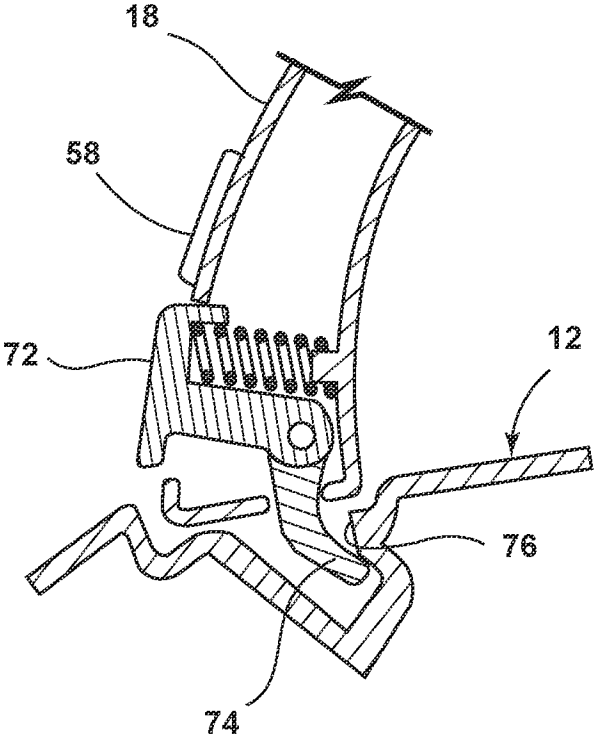
FIG. 7 is a schematic sectional view of a hand grip latch according to one aspect of the disclosure, the hand grip latch adapted to releasably latch the wand in the retracted position.

Referring to FIG. 7, in one non-limiting example, the grip latch 72 includes a spring-biased latch member 74 pivotally mounted on the hand grip 18, which is engageable with a corresponding abutment surface 76 or other portion on the body of the handheld unit 12. As the wand 14 is moved to its retracted position, the latch member 74 engages the abutment surface 76 and latches the hand grip 18 to the body of the handheld unit 12. Movement of the hand grip 18, and particularly the second end 70, into contact with the handheld unit 12 can automatically engage the latch member 74 with the abutment surface 76 to latch the hand grip 18 to the handheld unit 12.

The grip latch 72 may be a breakaway latch that normally restrains the hand grip 18 from separation from the handheld unit 12, but will allow separation upon the application of a predetermined external force on hand grip 18 or on the latch 72. Thus, a user may simply pull the hand grip 18 with sufficient force to extend the wand 14. Alternatively, a user may press on an exposed portion of the latch 72 to release the hand grip 18.

In another embodiment, rather than operating by releasably latching the hand grip 18 to the handheld unit 12, a second wand latch (not shown) can latch the handle 20 of the wand in the retracted position. In such an embodiment, the second wand latch is separate from the first wand latch 28.

In yet another embodiment, the wand latch 28 is operable to releasably latch the handle 20 in either the retracted position or the extended position, thereby requiring only a single wand latch.

In still another embodiment, where the handle 20 comprises a telescoping tubular assembly including inner tube 24 and outer tube 26, the structure for latching the telescoping tubes 24, 26, together can releasably latch the tubes 24, 26 together in a retracted position, which can also prevent extension of the wand 14 from the wand pocket 22.

Referring to FIGS. 3-4, the surface cleaning head 16 can comprise a supporting member 78 including a unit receiver 80 and a spine 82. The surface-engaging base 62 can be attached at one end of the supporting member 78.

The unit receiver 80 is adapted to support the handheld unit 12 in the upright mode. The unit receiver 80 can be recessed for complementary receipt of the nose end 48 of the handheld unit 12.

Referring additionally to FIG. 2, a working air conduit 84 can extend through the cleaning head 16, from the suction nozzle 50 to the unit receiver 80, in order to place the handheld unit 12 in fluid communication with the suction nozzle 50 when the handheld unit 12 is mounted to the receiver 80. The working air conduit 84 can include one or more rigid or flexible conduit sections, or a combination thereof, and may, in some embodiments.

The working air conduit 84 defines a portion of the working air path 30 through the apparatus 10 in the upright mode; the suction nozzle 50 and handheld unit 12 also define a portion of the working air path 30, with the suction nozzle 50 defining the dirty air inlet for the working air path 30. Accordingly, in the upright mode the working air path 30 can extend from the suction nozzle 50, through the base 62, into the suction inlet 32, and to the clean air outlet 44 on the handheld unit 12.

The spine 82 is adapted to support at least a rear side 86 of the handheld unit 12 when mounted to the surface cleaning head 16. In some embodiments, the spine 82 may support additional sides of the handheld unit 12 when mounted to the surface cleaning head 16, including, but not limited to, a right side, left side, and/or front side of the handheld unit 12.

For ease of maneuvering in the upright mode, a joint 88 can couple the base 62 to the supporting member 78, with the joint 88 configurator for movement about at least one axis of rotation, and alternatively configured for movement about multiple axes of rotation. In one embodiment, the joint 88 can couple the base 62 to the unit receiver 80. The working air conduit 84 may, in some embodiments, pass through joint 88.

A unit latch 90 can secure the handheld unit 12 to the surface cleaning head 16. In one non-limiting embodiment, the latch 90 is disposed in the unit receiver 80 and/or on the spine 82 of the supporting member 78 and is engageable with a corresponding abutment surface or other portion of the handheld unit 12. The unit latch 90 may be a breakaway latch that normally restrains the handheld unit 12 from separation from the supporting member 78, but will allow separation upon the application of a predetermined external force on the handheld unit 12 or on the supporting member 78. Other latching arrangements are possible.

The apparatus 10 can be provided with one or more accessory tools, such as, but not limited to, an upholstery nozzle 92 and a crevice tool 94. The accessory tools 92, 94 are configured to be coupled directly to the handheld unit 12 without the surface cleaning head 16, e.g. when the cleaning head 16 is removed. Conveniently, the tools 92, 94 can be stored on-board the apparatus 10. The apparatus 10 can have a tool mount 96, 98 for each tool 92, 94. For example, a first or nozzle tool mount 96 is disposed on the surface cleaning head 16 and a second or crevice tool mount 98 is disposed on the handheld unit 12. With the surface cleaning head 16 removed, one of the tools 92, 94 can be coupled to the forward end or nose 48 of the handheld unit 12. While not being limited to any particular cleaning operation, the upholstery nozzle 92 may be useful for cleaning furniture and stairs, and the crevice tool 94 may be useful for cleaning hard-to-reach and/or narrow areas.

The first tool mount 96 may be disposed rearward of the unit receiver 80 and, with the upholstery nozzle 92 connected to the first tool mount 96, the upholstery nozzle 92 is disposed rearward of the handheld unit 12 in the upright mode. In some embodiments, the upholstery nozzle 92 and/or tool mount 96 may form a continuation of the spine 82, or may otherwise provide support to the handheld unit 12 in the upright mode.

The second tool mount 98 may be disposed on an exterior surface of the handheld unit 12, with the crevice tool 94 connected to the second tool mount 98 and carriable on the handheld unit 12 in both the upright and handheld modes.

The nose end 48 of the handled unit 12 can comprise at least one connector configured to couple with a corresponding connector in the surface cleaning head 16. Such connectors can, for example, define a working air pathway, a liquid recovery pathway a fluid supply pathway, and/or an electrical supply pathway between the unit 12 and the cleaning head 16. In one non-limiting embodiment, the inlet duct 46 is a male connector configured to be received within a corresponding female connector (not shown) in the surface cleaning head 16, and which defines a portion of the working air path 30.

In embodiments of the surface cleaning apparatus 10 where one or more accessory tools 92, 94 are provided in addition to the surface cleaning head, the inlet duct 46 may be configured to be received within a corresponding female connector of the accessory tools 92, 94. Other configurations are possible, including configurations where the handheld unit 12 comprises a female connector and the surface cleaning head 16 or tools 92, 94 include male connectors.

In embodiments where the power source 52 supplies power to at least one electrical component in the surface cleaning head 16 in the upright mode, the inlet duct 46 or the nose end 48 can comprise an electrical connector to supply power to the cleaning head 16. Such electrical components include, but are not limited to, the brushroll motor 56 and/or a pump (not shown). The unit receiver 80 can comprise a corresponding electrical connector (not shown) configured to couple with the electrical connector on the inlet duct 46 or the nose end 48. The same electrical connectors can establish a data connection between the handheld unit 12 and the cleaning head 16.

The apparatus 10 according to at least some of the aspects described herein is easily adaptable for on-the-floor cleaner, above-floor cleaning, and accessory tool cleaning. The retractable wand 14, in being stowable on board the handheld unit 12 rather than detachable therefrom, provides an improved user experience and can reduce cleaning time by eliminating a cumbersome conversion process. The retractable wand 14 also improves the overall storability, as the wand can be retracted to store the apparatus 10 in a smaller space.

While primarily discussed herein in terms of a vacuum cleaner, the features of the surface cleaning apparatus disclosed herein are applicable to other types of surface cleaning apparatus, including any surface cleaning apparatus having a cleaning fluid delivery system, i.e. a multi-surface wet/dry vacuum cleaner, an extraction cleaner or deep cleaner, a steam cleaner, a wet mop, etc., with or without a vacuum cleaning function.

To the extent not already described, the different features and structures of the various embodiments of the disclosure, may be used in combination with each other as desired, or may be used separately. That one surface cleaning apparatus is illustrated herein as having all of these features does not mean that all of these features must be used in combination, but rather done so here for brevity of description. Thus, the various features of the different embodiments may be mixed and matched in various configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus comprising:

a surface cleaning head;

a handheld unit comprising a power source and a wand pocket;

a wand coupled with the handheld unit and configured to be retracted into the wand pocket, the wand including a hand grip extending forwardly from an upper end of the wand and downwardly in front of the upper end of the wand, the hand grip comprising a first end connected with the upper end of the wand and a second end positioned forward of the first end;

a user interface on the second end of the hand grip, the user interface enabling operation and control of the surface cleaning apparatus by a user; and an electrical conductor within the wand, the electrical conductor electrically coupling the user interface with the power source;

wherein the surface cleaning apparatus is convertible to one of:

an upright mode, where the wand is extendible from the handheld unit and the handheld unit is coupleable to the surface cleaning head to convert the surface cleaning apparatus to the upright mode, wherein the second end of the hand grip is spaced from and unconnected to the handheld unit in the upright mode; and a handheld mode, where the wand is retractable into the wand pocket on the handheld unit and the handheld unit is detachable from the surface cleaning head to convert the surface cleaning apparatus to the handheld mode, wherein the second end of the hand grip engages with the handheld unit in the handheld mode; and wherein the user interface is accessible to the user in both the upright mode and the handheld mode.

2. The surface cleaning apparatus of claim 1, wherein the power source comprises a battery electrically connected to at least one electrical component in the handheld unit, and wherein the battery supplies power to at least one electrical component in the surface cleaning head in the upright mode.

3. The surface cleaning apparatus of claim 1, comprising an accessory tool, wherein the accessory tool is configured to be coupled directly to the handheld unit without the surface cleaning head.

4. The surface cleaning apparatus of claim 1, wherein the wand comprises a telescoping tubular assembly including:

an inner tube; and an outer tube that slides along an outer surface of the inner tube.

5. The surface cleaning apparatus of claim 1, comprising a grip latch adapted to releasably latch the hand grip to the handheld unit and prevent extension of the wand from the wand pocket.

6. The surface cleaning apparatus of claim 1, wherein the second end of the hand grip comprises a latch for connection to the handheld unit in the handheld mode.

7. The surface cleaning apparatus of claim 1, wherein the hand grip and handheld unit form a closed loop handle in the handheld mode.

8. The surface cleaning apparatus of claim 1, wherein the hand grip extends;

over at least one of a rear portion and a top portion of the handheld unit in the handheld mode.

9. The surface cleaning apparatus of claim 1, wherein the user interface comprises at least one user input control.

10. The surface cleaning apparatus of claim 1, wherein the surface cleaning head comprises a base adapted to move over a surface to be cleaned and a unit receiver adapted to support the handheld unit in the upright mode.

11. The surface cleaning apparatus of claim 10, wherein the surface cleaning head comprises a spine adapted to support at least a rear side of the handheld unit when mounted to the surface cleaning head.

12. The surface cleaning apparatus of claim 10, wherein the base comprises at least one of:

a brushroll and a brush motor, and the unit receiver comprises an electrical connector to supply power from the power source in the handheld unit to the brush motor; and a joint coupling the base to the unit receiver for movement about at least a one axis of rotation.

13. The surface cleaning apparatus of claim 10, wherein:

the base comprises a first tool mount rearward of the unit receiver and a first accessory tool adapted to be connected to the first tool mount, wherein the first accessory tool is disposed rearward of the handheld unit in the upright mode; and the handheld unit comprises a second tool mount and a second accessory tool adapted to be connected to the second tool mount, wherein the second accessory tool is carriable on the handheld unit in the upright and handheld modes.

14. A surface cleaning apparatus comprising:

a surface cleaning head having a first inlet;

a handheld vacuum unit comprising a suction source comprising a vacuum motor, a collection container in fluid communication with the suction source, a second inlet in fluid communication with the collection container, a power source, and a wand pocket; and a wand coupled with the handheld vacuum unit, the wand comprising a hand grip at one end thereof and configured to be retracted into the wand pocket;

wherein the surface cleaning apparatus is convertible to at least one of:

an upright mode, where the wand is extendible from the handheld vacuum unit and the handheld vacuum unit is coupleable to the surface cleaning head with the second inlet of the handheld vacuum unit in fluid communication with the first inlet to convert the surface cleaning apparatus to the upright mode; and a handheld mode, where the wand is retractable into the wand pocket on the handheld vacuum unit and the handheld vacuum unit is detachable from the surface cleaning head to convert the surface cleaning apparatus to the handheld mode;

wherein the surface cleaning head comprises a spine adapted to support at least a rear side of the handheld vacuum unit when mounted to the surface cleaning head; and wherein the wand pocket is disposed rearwardly of the vacuum motor and the collection container, and the wand pocket extends between the spine and the collection container.

15. The surface cleaning apparatus of claim 14, wherein a portion of the hand grip extends over at least one of the vacuum motor and the collection container in the handheld mode.

16. The surface cleaning apparatus of claim 14, comprising:

a user interface on the hand grip, the user interface enabling operation and control of the surface cleaning apparatus by a user; and an electrical conductor within the wand, the electrical conductor electrically coupling the user interface on the hand grip with the power source;

wherein the user interface is accessible to the user in both the upright mode and the handheld mode.

17. The surface cleaning apparatus of claim 14, wherein:

the hand grip extends forwardly from an upper end of the wand and downwardly in front of the upper end of the wand;

the hand grip comprises a first end connected with the upper end of the wand and a second end positioned forward of the first end;

the second end of the hand grip is spaced from and unconnected to the handheld vacuum unit in the upright mode; and the second end of the hand grip is connected to the handheld vacuum unit in the handheld mode.

* * * * *